US007482549B2

(12) United States Patent
Madar et al.

(10) Patent No.: US 7,482,549 B2
(45) Date of Patent: Jan. 27, 2009

(54) METHOD OF IDENTIFYING OVERLAPPING ARTICLES

(75) Inventors: François Madar, Bourg-les-Valence (FR); Bruno Cartal, Montelier (FR); Didier Tresse, Saint Laurent D'Onay (FR)

(73) Assignee: Solystic, Gentilly Cedex (FR)

( * ) Notice: Subject to any disclaimer, the term of this patent is extended or adjusted under 35 U.S.C. 154(b) by 502 days.

(21) Appl. No.: 11/184,893

(22) Filed: Jul. 20, 2005

(65) Prior Publication Data

US 2006/0016730 A1 Jan. 26, 2006

(30) Foreign Application Priority Data

Jul. 22, 2004 (FR) ..... 04 51628

(51) Int. Cl.
*B07C 5/00* (2006.01)

(52) U.S. Cl. ..... 209/584; 209/900; 209/659

(58) Field of Classification Search ..... 209/583, 209/584, 900, 659; 700/219, 223–226
See application file for complete search history.

(56) References Cited

U.S. PATENT DOCUMENTS 3,955,812 A 5/1976 Suda et al.
4,121,716 A 10/1978 Luperti et al.
6,373,013 B1 * 4/2002 Yamashita et al. ..... 209/584

FOREIGN PATENT DOCUMENTS

| | | |
|---|---|---|
| DE | 196 25 043 C1 | 4/1997 |
| FR | 2 841 487 A | 1/2004 |
| GB | 2 279 634 A | 1/1995 |

* cited by examiner

*Primary Examiner*—Patrick H Mackey
*Assistant Examiner*—Mark Hageman
(74) *Attorney, Agent, or Firm*—Sughrue Mion, PLLC

(57) ABSTRACT

In a method of handling mail items in a postal sorting machine, in which method the mail items pass a first time and then a second time through the machine in compliance with a sorting plan, the following steps are performed: during the first sorting pass, and for each current mail item, measuring a physical magnitude specific to the mail item, and determining an expected sequence of mail items for the second sorting pass; and, during the second sorting pass, and for each current mail item, measuring the same physical magnitude once again, and, if it is determined that said current mail item is not the item expected in said sequence, comparing the physical magnitudes as measured for the same mail item respectively during the first pass and during the second pass so as to identify the presence of mail items in multiple takes.

8 Claims, 1 Drawing Sheet

METHOD OF IDENTIFYING OVERLAPPING ARTICLES

The present invention relates to a method of handling mail items in a postal sorting machine, in which method the mail items are passed a plurality of times through the machine in compliance with a sorting plan for preparing a delivery round or "delivery round".

BACKGROUND OF THE INVENTION

Mail items are inserted into a postal sorting machine by means of an unstacker which separates the mail items one-by-one from the stack and injects them into a conveyor serving the sorting outlets of the machine. Unstacking is a very important and difficult step in handling mail items. One known type of malfunctioning of a sorting machine is related to the fact that mail items might not be unstacked correctly, and are thus injected as a "multiple take" into the conveyor, i.e. by being mutually superposed or overlapping. This type of malfunctioning can occur during successive sorting passes.

A method is already known from Patent Document DE 19 625 043 for identifying the presence of mail items in multiple takes by combining probabilities on measurements of mail item length, height, and thickness.

Another method is also known from Patent Document GB 2 279 634 for detecting multiple takes by means of a system of belts driven at various speeds combined with measuring mail item length at the inlets and at the outlets of the system of belts.

Other methods of identifying the presence of mail items in multiple takes are also described in Patent Documents U.S. Pat. Nos. 3,955,812, 4,121,716 and FR 2 841 487.

OBJECTS AND SUMMARY OF THE INVENTION

An object of the present invention is to propose another method of handling mail items that is suitable for detecting multiple takes occurring between two sorting passes.

To this end, the invention provides a method of handling mail items in a postal sorting machine, in which method the mail items pass a first time and then a second time through the machine in compliance with a sorting plan, said method comprising the following steps:

during the first sorting pass, and for each current mail item, measuring a physical magnitude specific to the mail item, and, at the end of the first sorting pass, and on the basis of the passage of the mail items through the first sorting pass and on the basis of the sorting plan, determining an expected sequence of the mail items for the second sorting pass that is the order in which the mail items should be presented to the machine for the second sorting pass; and during the second sorting pass, and for each current mail item, measuring the same physical magnitude once again, and, if it is determined that said current mail item is not the item expected in said sequence, comparing the physical magnitudes as measured for the same mail item respectively during the first pass and during the second pass so as to identify the presence of mail items in multiple takes.

Preferably, comparison is performed between the physical magnitude as measured during the first pass and the physical magnitude as measured during the second pass for the mail item preceding the current mail item in the second sorting pass so as to verify whether or not the expected mail item detected as being absent is in a multiple take with the mail item preceding the current mail item.

In various particular implementations of the method of the invention, the physical magnitude measured is the thickness and/or the height and/or the volume and/or the weight of the current mail item.

In another implementation of the method of the invention, delivery points are assigned to the mail items, and, if the presence of at least two mail items in a multiple take is identified, the delivery points of the mail items in the multiple take are compared so as to direct them to the same sorting outlet.

The invention also provides a postal sorting machine arranged to implement the method defined above.

BRIEF DESCRIPTION OF THE DRAWING

The invention will be better understood on reading the following description and on examining the figures that accompany it. The description is given merely by way of example as-an indication that is in no way limiting to the invention.

In the figures.

MORE DETAILED DESCRIPTION

Figure 1:
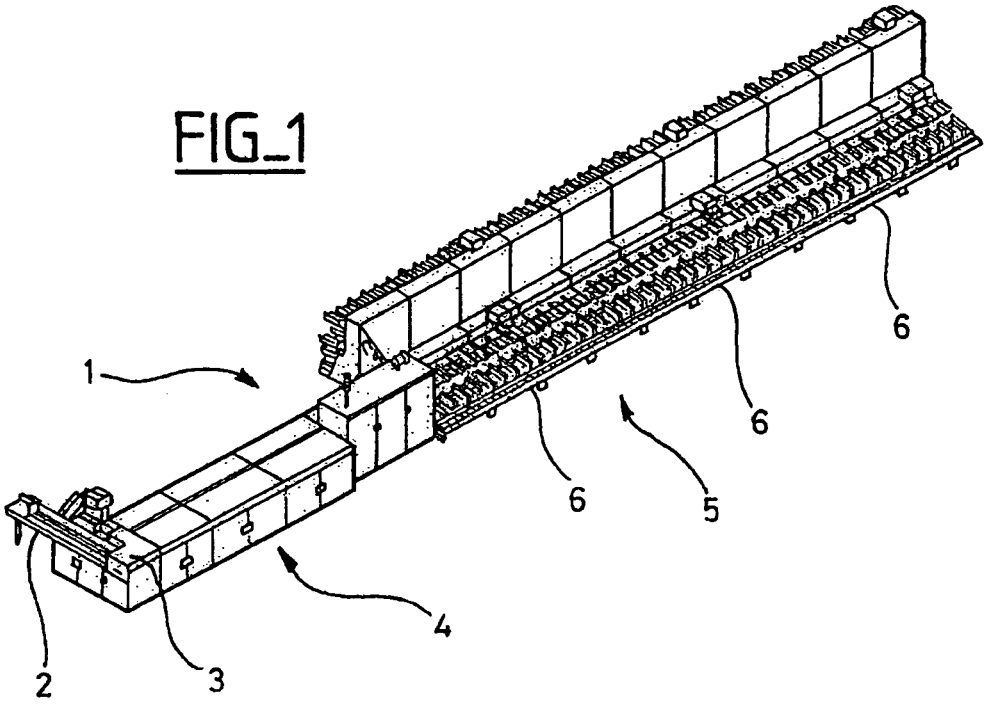
FIG. 1 is a diagrammatic perspective view of a sorting machine arranged to implement the method of the invention.

The postal sorting machine 1 shown in FIG. 1 comprises a mail item insertion bench 2, an unstacker 3, an automatic address reader unit 4, and a conveyor 5 for conveying mail items towards sorting outlets 6.

During the first sorting pass, an operator stands mail items on edge on the insertion bench 2, which mail items are separated one-by-one by the unstacker 3 and injected into the automatic address reader unit 4. Various members of the automatic address reader unit 4, such as a device for performing address recognition by an optical character recognition/video coding system, or an identity bar code reader, determine that sorting outlet 6 to which each mail item is sent as a function of the delivery point to which it is assigned and of the predetermined sorting plan. The mail items contained in the sorting outlets 6 are reinserted in the sorting machine 1 while preserving a precise order for a second sorting pass, by the end of which they are sorted in compliance with the predetermined sorting plan, e.g. for the delivery round.

In the method of the invention, the sequence of the mail items observed during the first pass is stored in a memory, i.e. for each current mail item, a mail item identifier is put into correspondence with the order in which the mail item passes through the first sorting pass, or with the order in which it is unloaded into each sorting outlet during the first sorting pass. For each current mail item, its delivery point is also stored in a memory, as is a physical magnitude specific to the mail item, and suitable for distinguishing a multiple take. The identifier of the mail item is, for example, an identity code or "ID tag", or indeed a digital imprint of the mail item as described in Patent Application FR-2 841 673. On the basis of the sequence of mail items observed during the first pass, on the basis of the knowledge of the delivery points assigned to the mail items, and on the basis of the sorting plan, it is possible to calculate an expected sequence of mail items for the second sorting pass that is the order in which the mail items should be presented in the machine for the second sorting pass. Therefore, merely by comparing the expected sequence with the real sequence obtained during the second pass, it is possible to detect whether a mail item present during the first pass is no longer present during the second pass. Non-detection of one or more mail items can be due to a multiple take, or to unloading erroneously not taking place, or to a handling error. In order to maximize the efficiency of the sorting machine by avoiding rejecting mail items unnecessarily, it is advantageous to determine whether or not such non-detection is due to a multiple take. The physical magnitude of a mail item of the expected sequence for the second sorting pass is compared with the physical magnitude of the corresponding mail item in the real sequence for the second pass. The physical magnitude specific to the mail item and suitable for distinguishing a multiple take is, for example, its height, its length, its volume, its area, or indeed its weight, and said physical magnitude is measured by means of suitable known detectors that are preferably already available in the sorting machine 1. For example, methods of detecting multiple takes on the basis of mail item length are known from Patent Documents FR 2 842 127 and U.S. Pat. No. 6,737,633. Other techniques can also be used to distinguish multiple takes such as outline analysis as known from Patent Document FR 2 841 487.

Figure 2:
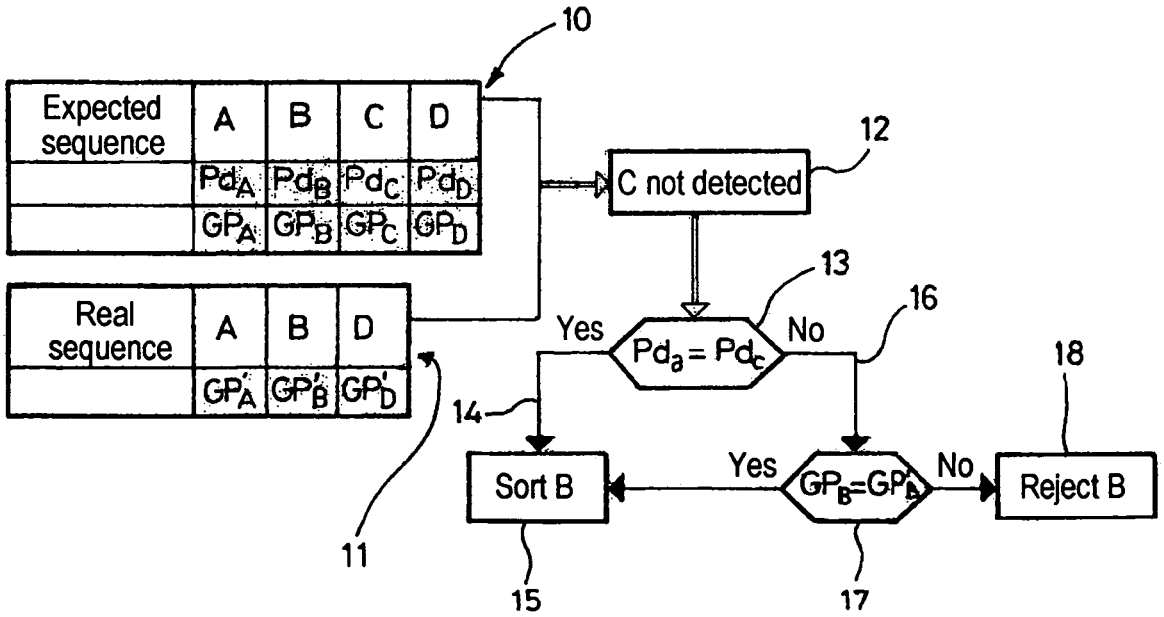
FIG. 2 is a block diagram showing the various steps in the method of the invention with reference to a particular case of sorting.

FIG. 2 makes it possible to understand the invention better with reference to a particular example. During a first sorting pass, a sequence of mail items passing through the automatic address reader unit 4 goes past an identity bar code reader, a thickness sensor, and a height and width sensor, and each mail item is routed to a sorting outlet 6 determined on the basis of the predetermined sorting plan and on the basis of the delivery point obtained from the identity code. The thickness, the height, and the length of the mail item make it possible to determine its volume. On the basis of the order in which the mail items have passed through at the end of the first sorting pass, on the basis of the delivery points assigned to the mail items, and on the basis of the sorting plan, the sorting machine 1 computes the mail item sequence that is expected for the second pass, i.e. the expected identity code sequence, while preserving the correspondence between delivery points and item volumes.

FIG. 2 shows an expected sequence 10 of four consecutive mail items, designated respectively by A, B, C, and D and recognized by their identity codes. The references $Pd_A$, $Pd_B$, $Pd_C$, $Pd_D$ represent the respective delivery points for the mail items, and the references $GP_A$, $GP_B$, $GP_C$, $GP_D$ represent the respective physical magnitudes of the mail items measured during the first pass and more particularly their volumes. FIG. 2 also shows a corresponding real sequence 11 obtained during the second pass, which real sequence differs from the expected sequence 10 as regards the consecutive mail items constituted by the mail items A, B, and D, with respective volumes of $GP'_A$, $GP'_B$, $GP'_D$.

Successively, it is determined whether the current mail item in the real sequence 11 is indeed the expected mail item in the expected sequence 10. In the example shown in FIG. 2, the first mail item A that passes does indeed correspond to the expected first mail item A. The second mail item B that passes also corresponds to the expected second mail item B. However, the third mail item D that passes does not correspond to the expected third mail item C but rather it is a nearby mail item in the expected sequence 11. Comparison between the expected sequence 10 and the real sequence 11 shows that the mail item C that should have passed between the mail items B and D was not detected in step 12. The mail item C is not in the real sequence 11 either due to an error, or due to it being in a multiple take with the mail item B preceding the current mail item (or with the current mail item D depending on the configuration of the postal sorting machine as regards the unstacker 3 and the automatic address reader 4). In order to avoid sorting the mail item C improperly, which would have serious consequences for postal delivery, it is assumed that the mail item C is in a multiple take with the mail item B. It is thus necessary to know whether the mail item B should be sorted or rejected. For this purpose, a step of the method of the invention referenced 13 in FIG. 2 makes it possible, on the basis of the information stored in correspondence with the expected sequence 10, to determine whether the mail items B and C should be sent to the same sorting outlet 6 or more particularly whether the delivery point $Pd_B$ of the mail item B is the same as the delivery point $Pd_C$ of the mail item C. During the second pass, mail items having the same delivery point have a good probability of being consecutive in the sequence. When the delivery points $Pd_B$ and $Pd_C$ are identical as they are at the output 14 of step 13, the mail item B is sorted at step 15, and therefore, in the event of a multiple take, the mail item C is sorted correctly. Otherwise, at the output 16 of step 13, checking is performed in a step 17 to determine whether the mail items B and C are in a multiple take by comparing the volume $GP_B$ of the mail item B as measured during the first sorting pass with the volume $GP'_B$ of the mail item B as measured during the second pass. If the difference between the volumes $GP_B$ and $GP'_B$ does not exceed a given threshold, it is considered that the mail item B is not in a multiple take with the mail item C, and the mail item B is sorted at step 15. Otherwise the mail item B is rejected at step 18, and therefore so is the mail item C. The mail items B and C are subsequently sorted by hand.

The method of the invention makes it possible in reliable manner to reject mail items in multiple takes whenever necessary and to avoid as far as possible rejecting mail items that are assumed to be in multiple takes when, in fact, they are not.

The method of the invention described with reference to FIG. 2 when a single mail item is not detected can naturally apply when two or more mail items are not detected. For this purpose, in step 13, it is determined whether all of the mail items that are assumed to be in a multiple take have the same delivery point, and in step 17 the threshold for comparison of the volumes is adapted accordingly.

Steps 13 and 17 can be interchanged or independent.

The above-described method of handling mail items in two sorting passes can naturally be applied for handling mail items in more than two sorting passes.

Knowledge of the expected sequence for the second sorting pass and of the thicknesses (physical magnitudes) of the mail items as measured during the first sorting pass can also serve to dimension the logistics needs, and in particular number of bins required, number of simultaneous delivery rounds, packaging of the mail items by delivery point or by group of delivery points, etc., for the downstream sorting and delivery process.

What is claimed is:

1. A method of handling mail items in a postal sorting machine with sorting outlets, in which method the mail items are conveyed in the machine towards said sorting outlets during a first sorting pass of a sorting plan to obtain first time sorted mail items, and then the first time sorted mail items are conveyed again in the machine towards said sorting outlets during a second sorting pass of the sorting plan, said method comprising the following steps:

during the first sorting pass, assigning to each mail item a machine readable identity code and storing in memory said identity code into a first sequence of identity codes corresponding to a first passage order of said mail items in the machine during the first sorting pass, measuring in the machine a physical magnitude specific to each mail item and storing in memory said measured physical magnitude, computing an expected passage order of said mail items in the machine for the second sorting pass on the basis of said first sequence of identity codes and said sorting plan and storing in memory a second sequence of identity codes which corresponds to said expected passage order of said mails items, during the second sorting pass, measuring and storing the same physical magnitude once again for each current mail item, determining from said second sequence of identity codes if said current mail item is the mail item expected in said second sequence and conveying said current mail item a sorting outlet, and if said current mail item is not the expected mail item, comparing the physical magnitudes measured and stored during the first sorting pass and during the second sorting pass to detect a mail item in multiple takes and upon said detection, conveying in the machine said detected mail item in multiple takes towards a rejection sorting outlet.

2. A method according to claim 1, in which said comparison is performed on the physical magnitude of the mail item preceding the current mail item.

3. A method according to claim 1, in which the physical magnitude measured is the thickness of the mail item.

4. A method according to claim 1, in which the physical magnitude measured is the height of a mail item.

5. A method according to claim 1, in which the physical magnitude measured is the length of a mail item.

6. A method according to claim 1, in which the physical magnitude measured is the volume of a mail item.

7. A method according to claim 1, in which the physical magnitude measured is the weight of a mail item.

8. A method according to claim 1, in which delivery points are assigned to the mail items, and in which, if at least two mail items are detected in multiple takes, the delivery points of said mail items in multiple takes are compared so as to convey them in the machine towards the same sorting outlet.

* * * * *